United States Patent [19]

Daughton et al.

[11] Patent Number: 5,012,284

[45] Date of Patent: Apr. 30, 1991

[54] MAGNIFICATION ADJUSTMENT FOR COMPUTER FORMS

[75] Inventors: John W. Daughton; Robert L. Sklut, both of Rochester, N.Y.

[73] Assignee: Xerox Corporation, Stamford, Conn.

[21] Appl. No.: 414,797

[22] Filed: Sep. 29, 1989

[51] Int. Cl.[5] ..... G03G 15/00

[52] U.S. Cl. ..... 355/243; 355/55; 355/75; 355/311

[58] Field of Search ..... 355/243, 55, 60, 63, 355/75, 309, 311, 316, 317

[56] References Cited

U.S. PATENT DOCUMENTS

| | | | |
|---|---|---|---|
| 4,485,949 | 12/1984 | Gebhart et al. | 226/2 |
| 4,575,227 | 3/1986 | Ito et al. | 355/56 |
| 4,579,444 | 4/1986 | Pinckney et al. | 355/317 |
| 4,647,188 | 3/1987 | Kemiya et al. | 355/55 |
| 4,647,189 | 3/1987 | Fujiwara et al. | 355/55 |
| 4,669,858 | 6/1987 | Ito et al. | 355/8 |
| 4,714,944 | 12/1987 | Yoshiura | 355/55 |
| 4,745,438 | 5/1988 | Acquaviva et al. | 355/55 X |
| 4,809,050 | 2/1989 | Ito | 355/145 H |
| 4,827,310 | 5/1989 | Shibazaki et al. | 355/243 |

*Primary Examiner*—R. L. Moses

*Attorney, Agent, or Firm*—H. Fleischer; J. E. Beck; R. Zibelli

[57] ABSTRACT

A printing machine in which the magnification of an image of a computer form is adjusted so that a copy thereof fits on a selected size copy sheet. The width and the number of holes of a computer form are inputted into the printing machine. In addition, the size of the selected copy sheet is inputted into the printing machine. This information is used by the printing machine to calculate the magnification of the image and to form an image of the computer form with the magnification adjusted so that the copy of the computer form fits on the selected size copy sheet.

15 Claims, 6 Drawing Sheets

MAGNIFICATION ADJUSTMENT FOR COMPUTER FORMS

This invention relates generally to a printing machine, and more particularly concerns a printing machine in which the magnification of an image of a computer form is adjusted for a selected size sheet.

A wide variety of printing machines with variable magnification have been commercialized. When printing with a variable magnification printing machine, the size of the original document, the size of the copy sheet and the desired magnification must be determined. Normally two of these parameters are selected with the third parameter being determined as a function of the other parameters. Printing is performed automatically as a function of these three parameters. For example, when the operator sets the size of the original document and the size of the copy sheet, the printing machine calculates the maginification ratio so that the copy of the original document fits on the selected copy sheet. A number of printing machines detect the size of the original document, and, at the operator's choice, select either the size of the copy sheet to be used or compute the magnification setting to "best fit" the image of the original document onto a selected size copy sheet. However, when an operator is reproducing computer forms, this array of automatic selection features is not available. Various systems have been devised for adjusting the magnification of an image. The following disclosures appear to be relevant:

U.S. Pat. No. 4,575,227, Patentee: Ito et al. Issued: Mar. 11, 1986.

U.S. Pat. No. 4,647,188, Patentee: Komiya et al. Issued: Mar. 3, 1987.

U.S. Pat. No. 4,647,189, Patentee: Fujiwara et al. Issued: Mar. 3, 1987.

U.S. Pat. No. 4,669,858, Patentee: Ito et al. Issued: Jun. 2, 1987.

U.S. Pat. No. 4,714,944, Patentee: Yoshiura. Issued: Dec. 22, 1987.

U.S. Pat. No. 4,809,050, Patentee: Ito et al. Issued: Feb. 28, 1989.

U.S. Pat. No. 4,827,310, Patentee: Shibazaki et al. Issued: Mar. 2, 1989.

The disclosures of the above-identified patents may briefly summarized as follows:

U.S. Pat. No. 4,575,227 and U.S. Pat. No. 4,669,858 disclose copying machines having the capability of reproducing images at different magnifications. The size of the original and the size of various available copy sheets are calculated to determine an optimum magnification ratio. A controller determines whether the calculated ratio can be used within a predetermined range of values.

U.S. Pat. No. 4,647,188 describes an image forming system which has automatic or manual paper size selection manually inputted or automatically calculated magnification factors, and an automatic selection mode controller for generating an adjusted paper size or adjusted magnification factor.

U.S. Pat. No. 4,647,189 disclose an electrophotographic copying machine with variable magnification which determines a variable magnification ratio based on automatically sensed copy document size information and manually inputted copy document size information. A manual mode selection enables inputting of copy document dimensions and storing them in memory. The magnification ratio is determined from this information.

U.S. Pat. No. 4,714,944 describes a variable magnification copying machine with automatic magnification which provides automatic setting of the magnification by manually inputting paper length dimensions, computing length/width ratios for draft paper and copying paper, and setting the smallest ratio obtained as the correct magnification. The copying machine is adaptable to draft paper of any size.

U.S. Pat. No. 4,809,050 discloses a copying machine for copying a document at various magnifications which has a plurality of copy sheet feeders. The size of the original document is detected and the magnification ratio designated. The copy sheet feeder is also selected as a function of the size of the original document and the magnification ratio.

U.S. Pat. No. 4,827,310 describes a copy magnification setting device for an electrophotographic copying apparatus. Magnification ratios may be manually inputted and stored in a plurality of memories. One of the stored magnification ratios is selected for setting the magnification ratio of the copying apparatus.

In accordance with one aspect of the present invention, there is provided a printing machine in which the magnification of an image of an original document having a plurality of equally spaced holes in at least one marginal edge thereof is adjusted for a selected size sheet. The printing machine includes input means for inputting the total number of holes along one marginal edge of the original document and the width of the original document in a direction substantially perpendicular to the edge of the original document having the holes therein. The inputting means also inputs the selected size sheet. Calculating means, responsive to the input means, determine the magnification of the image for the selected size sheet. Image forming means, responsive to the calculating means, is provided for forming the image of the original document with the magnification adjusted for the selected size sheet.

Pursuant to another aspect of the present invention, there is provided an image forming system in which the magnification of an image of an original document having a plurality of equally spaced holes in at least one marginal edge thereof is adjusted for a selected size sheet. The image forming system includes original size input means for inputting the total number of holes along one marginal edge of the original document and the width of the original document in a direction substantially perpendicular to the edge of the original document having the holes therein. Sheet size input means input the size of the selected sheet. Calculating means, responsive to the original size input means and the sheet size input means, determines the magnification of the image for the selected size sheet.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended cover all alternatives, modifications and equivalents as may be included within the spirit and scope of the invention as defined by the appended claims.

Figure 1:
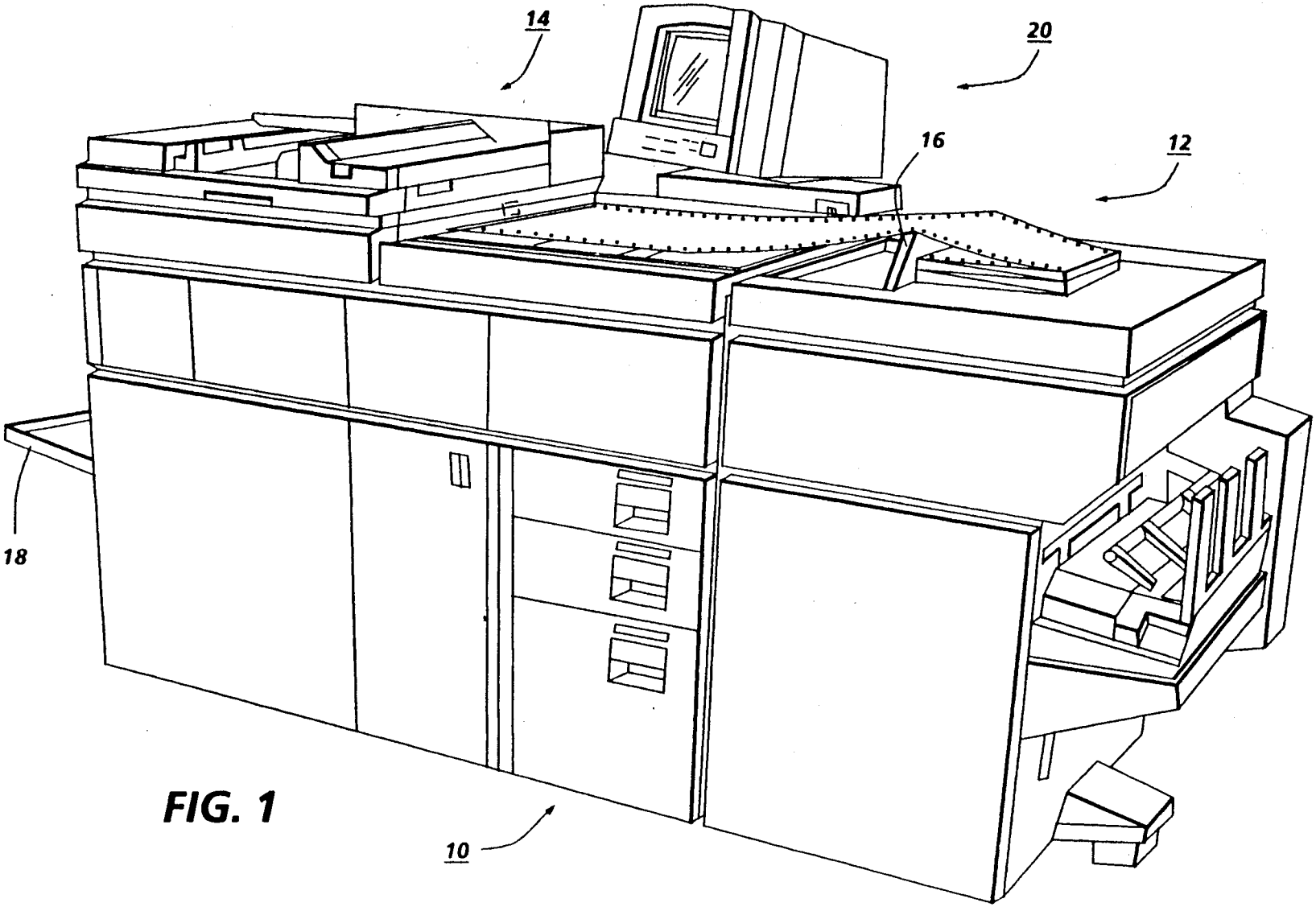
FIG. 1 is a perspective view depicting an illustrative electrophotographic printing machine reproducing computer forms.

For a general understanding of the features of the present invention, reference is made to the drawings. In the drawings, like reference numerals have been used throughout to designate identical elements. FIG. 1 schematically depicts an electrophotographic printing machine reproducing copies computer forms being advanced by a computer forms feeder. It will become evident from the following discussions that the features of the present invention are not specifically limited in their application to the particular embodiment depicted herein.

Referring now to FIG. 1 of the drawings, the printing system and its operation will be described with reference thereto. Inasmuch as the art of electrophotographic printing is well known, the operation of the printing machine will be described briefly.

The electrophotographic printing machine, generally designated by the reference numeral 10, is shown reproducing copies of computer forms, indicated generally by the reference numeral 12. A document feeder, indicated generally by the reference numeral 14 is shown positioned above a platen at the imaging station of printing machine 10. Document feeder 14 is adapted to feed a fanfold stack of computer forms so that individual computer forms advance, in seriatim, to the platen for copying. A stack of computer forms are fanfolded with the web of computer forms 12 passing over fanfold guide 16 across the printing machine into document feeder 14. The computer form or sheet is fed by a belt in document feeder 14 to the platen. After imaging, the computer forms are fed from the platen by the belt into output tray 18 where a fanfold of computer forms is stacked. Document feeder 14 will be described hereinafter in greater detail with reference to FIGS. 2 and 3. Imaging of each computer form is achieved by a flash lamp and lens. The flash lamp illuminates successive computer forms. Light rays reflected from the computer are transmitted through the lens. The lens focuses the light image of the computer form onto the charged portion of photoconductive belt to selectively dissipate the charge thereon. This records an electrostatic latent image on the photoconductive belt which corresponds to the informational areas contained within the computer form. The distance between the computer form on the platen and the photoconductive belt as well as the position of the lens is adjusted to set the magnification of the image. The magnification is automatically set so that the copy of the computer forms fits onto the selected size copy sheet. The machine operator selects one of four pre-set widths corresponding to the width of the computer form, the number of holes of each computer form, and the size of the copy sheet on a user interface, designated generally by the reference numeral 20. User interface 20 is a touch screen. Alternatively, the size of the copy sheet may be inputted automatically. This information is transmitted to the centralized processing unit of the printing machine which calculates the magnification required to fit the image of the computer form onto the copy sheet. By way of example, the centralized processing unit may be a microprocessor or a distributed system of microprocessors.

In general, the electrophotographic printing machine includes a belt having a photoconductive surface deposited on a conductive substrate. The belt advances successive portions of the photoconductive surface to various processing stations disposed about the path of movement thereof. Initially, a portion of the belt passes through a charging station. At the charging station, a corona generating device charges the photoconductive surface of the belt to a relatively high, substantially uniform potential. Thereafter, the charged portion of the photoconductive surface is advanced through the imaging station. At the imaging station, a flash lamp illuminates the computer form. The light rays reflected from the computer form or original document are transmitted through the lens forming a light image thereof. These light rays are focused onto the charged portion of the photoconductive surface to selectively dissipate the charge thereon. This records an electrostatic latent image on the photoconductive surface which corresponds to the informational areas contained within the computer form disposed upon the platen. After the electrostatic latent image is recorded on the photoconductive surface, the belt advances it through a development station. At the development station, a magnetic brush development system transports a developer material of carrier granules and toner particles into contact with the electrostatic latent image recorded on the photoconductive surface. The toner particles are attracted from the carrier granules to the electrostatic latent image forming a developed image or a toner powder image on the photoconductive surface of the belt.

After development, the belt advances the developed image to a transfer station. At the transfer station, a copy sheet is moved into contact with the toner powder image. A corona generating device sprays ions onto the backside of the copy sheet. This attracts the toner powder image from the photoconductive surface to the copy sheet. After transfer, the copy sheet moves to the fusing station. The fusing station includes a fuser assembly which permanently affixes the transferred toner powder image to the copy sheet. By way of example, the fuser assembly includes a heated fuser roll and back-up roll. The copy sheet passes between the fuser roll and back-up roll with the toner powder contacting the fuser roll. In this manner, the toner powder image is permanently affixed to the copy sheet. After fusing, a conveyor belt guides the advancing sheet to a catch tray or to a finishing station wherein a plurality of sets may be formed with the copy sheets being either stapled or bound to one another.

Figure 2:
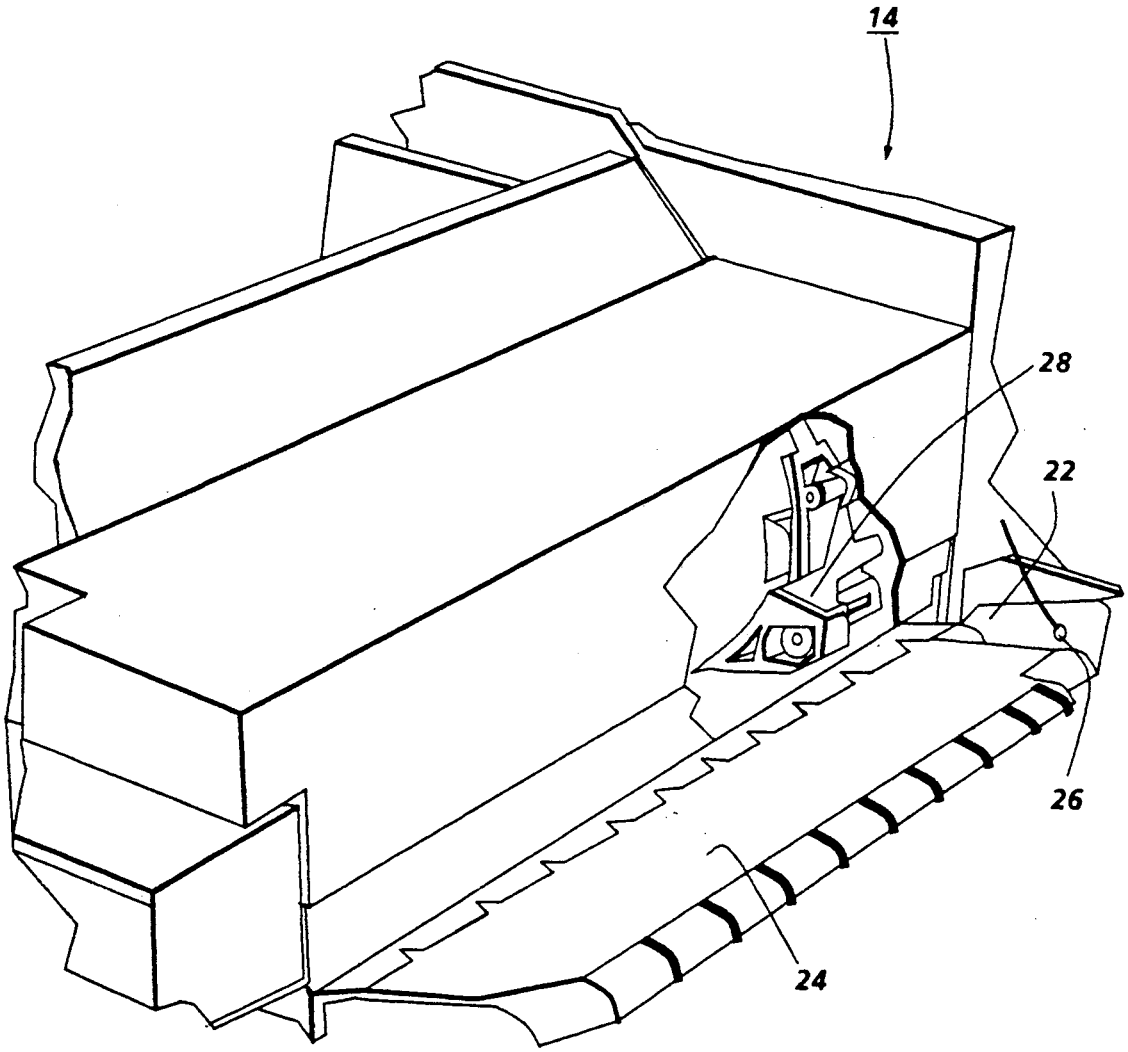
FIG. 2 is a fragmentary, perspective view of the FIG. 1 computer forms feeder.

Turning now to FIG. 2, there is shown a fragmentary perspective view of document feeder 14. The first computer form of the fanfolded stack is placed on input tray 24 with one side edge thereof aligned against registration edge 22. A light emitting diode 26 indicates that the computer form has been properly registered in the document feeder. An optical sensor, indicated generally by the reference numeral 28, includes a photodiode and a light emitting diode for detecting when the lead edge of the first computer form is inserted into the document feeder. The operator must select computer forms feeding box 40 (FIG. 5) on touch screen 20 to inform the printing machine that the document detected by sensor 28 is a computer form rather than an individual original document. This changes the mode of operation of document feeder 14 from a recirculating document feeder where single sheets are advanced across the platen to a stream feed document feeder for continuous form feeding of successive computer forms across the platen. After the computer forms are reproduced, they are stacked fanfold in output tray 18.

Figure 3:
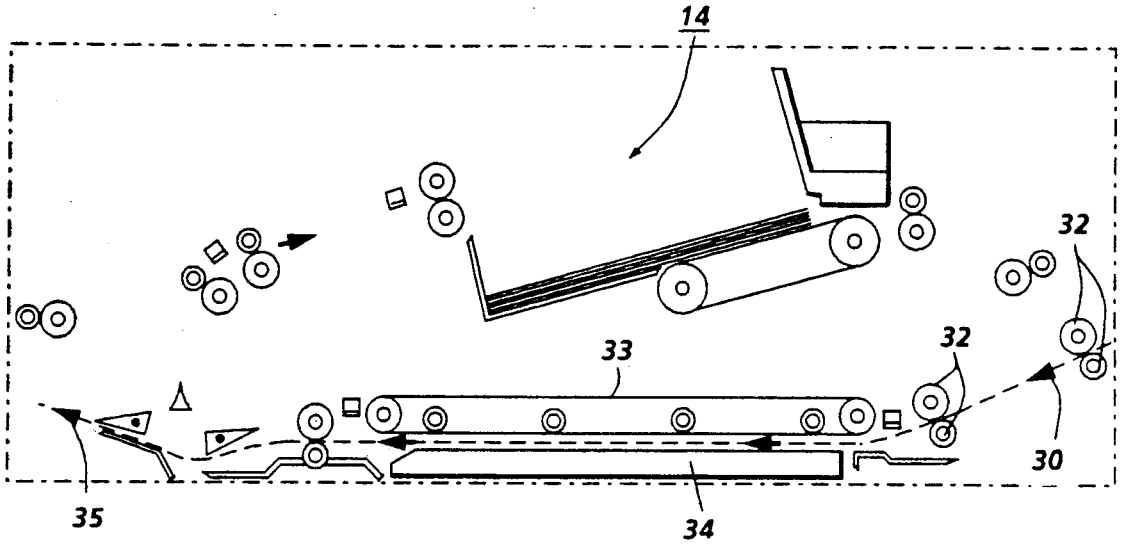
FIG. 3 is a schematic elevational view of the FIG. 2 computer forms feeder used in the FIG. 1 printing machine.

FIG. 3 depicts document feeder 14 schematically. As illustrated, the computer forms web advances in the direction of arrow 30. The first computer form of the web of computer forms is placed on input tray 24 and detected by optical sensor 28. Detector 28 transmits a signal to the centralized processing unit indicating the presence of a stack of fanfolded computer forms. In response to the operator selecting computer forms feeding box 40 (FIG. 5) on touch screen 20, the centralized processing unit switches the document feeder from the recirculating or single sheet mode to the continuous forms feed mode of operation. Rolls 32 advance the web of computer forms in the direction of arrow 30 into the nip defined by belt 32 and platen 34. Belt 32 advances successive computer forms onto platen 34. After imaging each computer form, belt 34 advances the computer form in the direction of arrow 32 to output tray 18.

Figure 4:
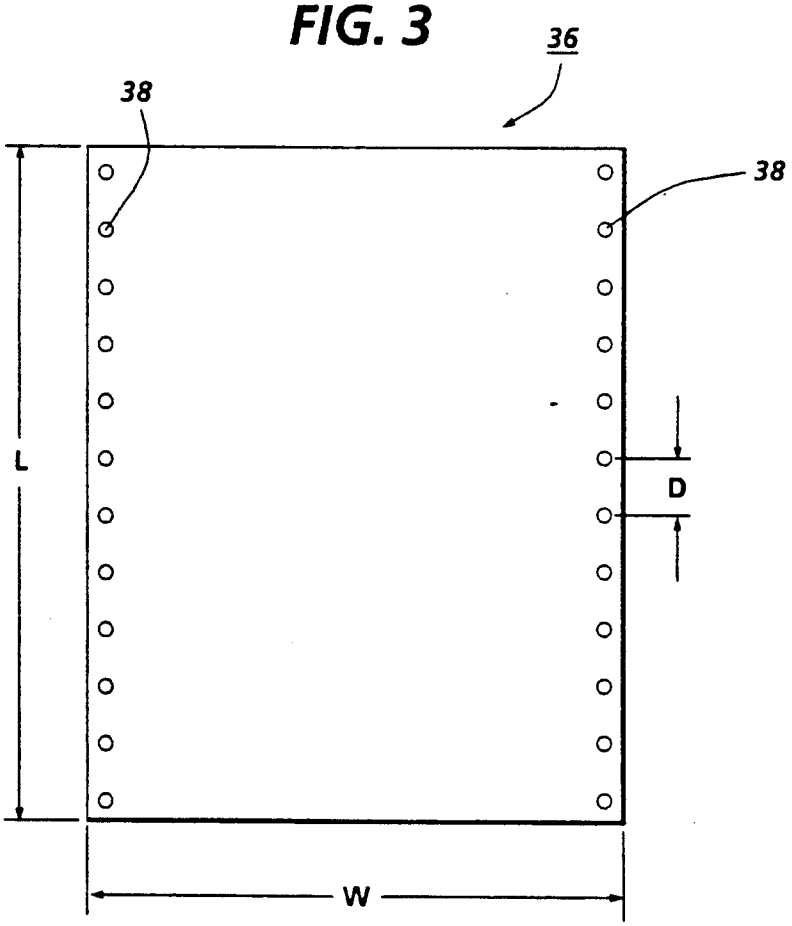
FIG. 4 is a plan view of a computer form.

Referring now to FIG. 4, there is shown an illustrative single computer form indicated generally by the reference numeral 36. Computer form 36 has a plurality of sprocket holes 38 in opposed side marginal regions thereof. Holes 38 are equally spaced (d) from one another with each hole being spaced ½ inch from the next adjacent hole. The length (L) of computer form 36 may be determined by multiplying the number of holes by the spacing between adjacent holes, i.e. ½ inch. The width (W) of computer form 36 may be one of four preset form widths. In the United States, these four standard widths are 14.9 inches, 10 inches, 9.5 inches, and 8.5 inches. In other countries, the preset widths may vary. The four preset widths are originally stored in the non-volatile memory of the centralized processing unit and displayed on the user interface 20 to the operator. The preset widths displayed may be changed by a trained machine operator. The operator selects the preset width corresponding to the width of computer form 36. The operator also counts the number of sprocket holes in computer form 36 and inputs this information to the centralized processing unit. The centralized processing unit scales the inputted number of sprocket holes by the optimally selected preset width and the spacing between adjacent sprocket holes, ½ inch, to determine the semi-perimeter, i.e. length and width, of computer form 36. The semi-perimeter, i.e. the length and width, of the selected copy sheet is divided by the semi-perimeter, i.e. length and width, of the computer form to determine the magnification to "best fit" the image of the computer form onto the selected copy sheet. In this way, the largest image, within the capability of the magnification system, that does not cause any portion of the image to be lost is reproduced on the selected copy sheet. The centralized processing unit controls the position of the platen and lens to set this magnification in the printing machine. The trained machine operator may define the length of the computer form (number of holes) and the preset form width as default values along with the specific copy sheet tray, i.e. size of the copy sheet. When this information is stored as default values, the operator need only select the select computer forms feeding box 40 (FIG. 5) on touch screen 20 to obtain the "best fit" and will not have to make any additional selections.

Figure 5:
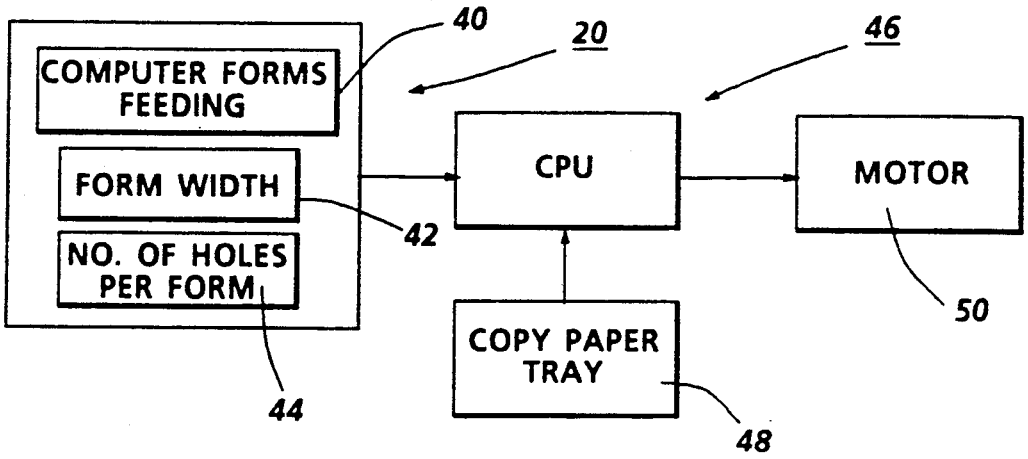
FIG. 5 is a block diagram of the system for adjusting the magnification of the image of the original document to fit onto the copy sheet.
Figure 7A:
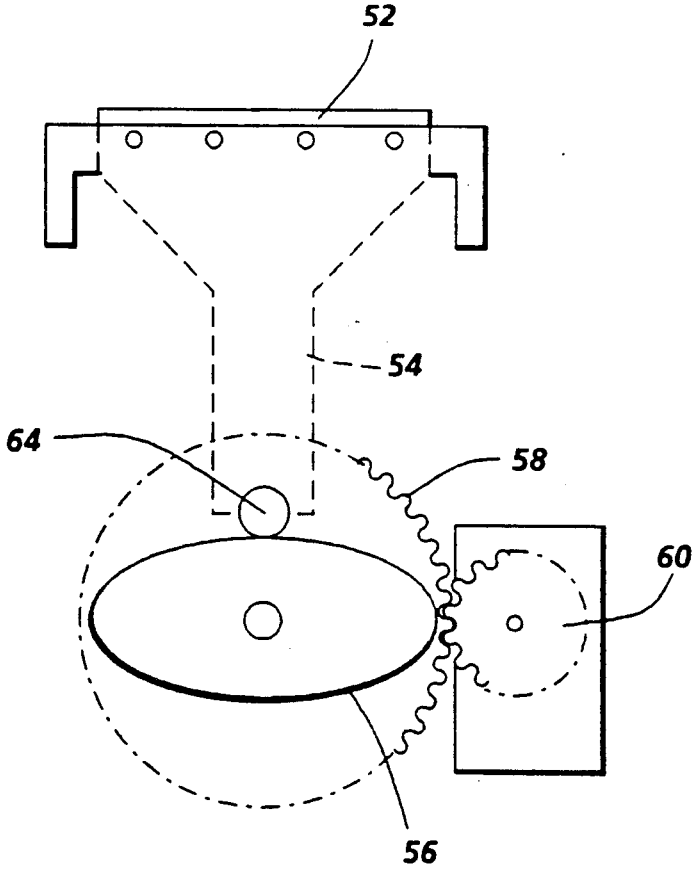
FIGS. 7*a* through 7*c*, inclusive, schematically illustrate the movement of the FIG. 6 optical system to adjust magnification.

FIG. 5 is a block diagram of the system for controlling the magnification of the computer form. As shown thereat, touch screen 20 includes a region which when actuated by the operator displays the options for computer forms. The computer forms option displayed on touch screen 20 includes box 40 which, when selected by the operator transmits a signal to the centralized processing unit (CPU), designated generally by the reference numeral 46, that the computer form mode of operation has been selected. The operator next optimally selects box 42 to input one of four widths displayed on the touch screen 20. A signal corresponding to the selected width is transmitted to the CPU. The operator then selects box 44 to input the number of holes in the computer form to CPU 46. In this mode of operation, the CPU calculates the magnification and sets the position of the platen and lens of the imaging system. Alternatively, the first computer form may be a calibration form used to set the magnification. In this configuration, a light emitting diode and a photodiode coupled to CPU 46 can provide an automatic count of the number of holes in the computer form. The photodiode transmits a pulse to the CPU for each hole in the computer form and the CPU counts the number of pulses to determine the number of holes in the computer form. In either case, CPU 46 scales the number of holes by the operator selected width and a constant, i.e. ½ inch, corresponding to the spacing between adjacent holes, to determine the semi-perimeter of the computer form. The size of the copy sheet is also inputted to the CPU. The copy sheets are placed in a tray. Different trays may hold different size copy sheets. The size of the tray determines the number of switches that are actuated when the tray is placed in the copying machine. For example, if the tray is holding copy sheets that are 8½ inches by 11 inches, only one switch may be actuated. Alternatively, if the tray is holding copy sheets that are 8½ inches by 14 inches, two switches may be actuated. As shown in FIG. 5, the output signal from the copy paper tray is transmitted to CPU 46. CPU 46 determines the size of the selected copy sheets as a function of the combination of switches actuated by the copy paper tray. The magnification is calculated by dividing the size, i.e. semi-perimeter, of the copy sheet by the size, i.e. semi-perimeter, of the computer form, and using the smaller value within the range of the magnification system as the desired magnification. The signal from the CPU corresponding to the desired magnification controls motor 50. Motor 50 positions the platen and lens of the printer to set the optics at the desired magnification. In this way, the magnification is adjusted so that the image of the computer form fits on the selected size copy sheet.

Figure 6:
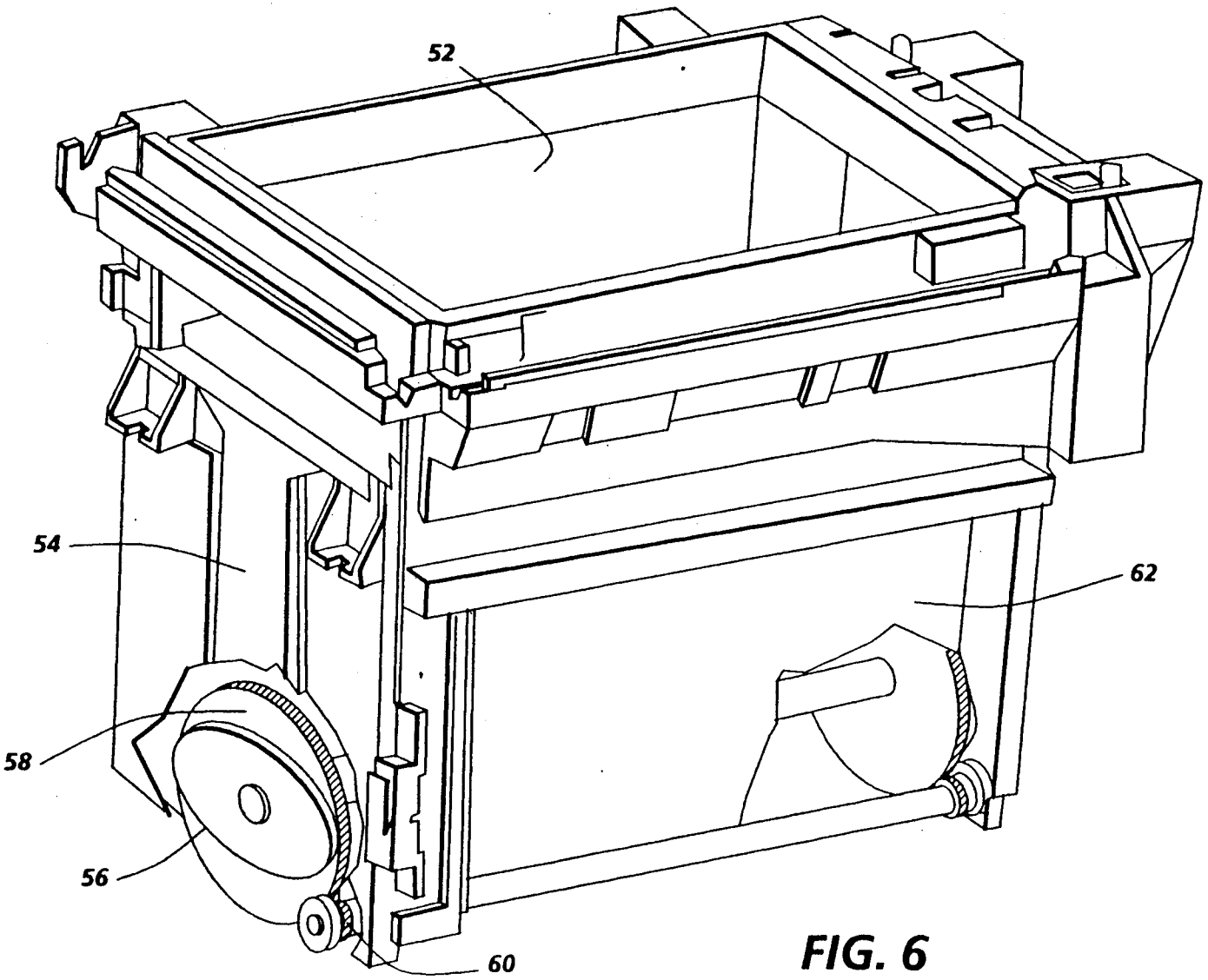
FIG. 6 is a fragmentary, perspective view of the optical system used in the FIG. 1 printing machine.
Figure 7B:
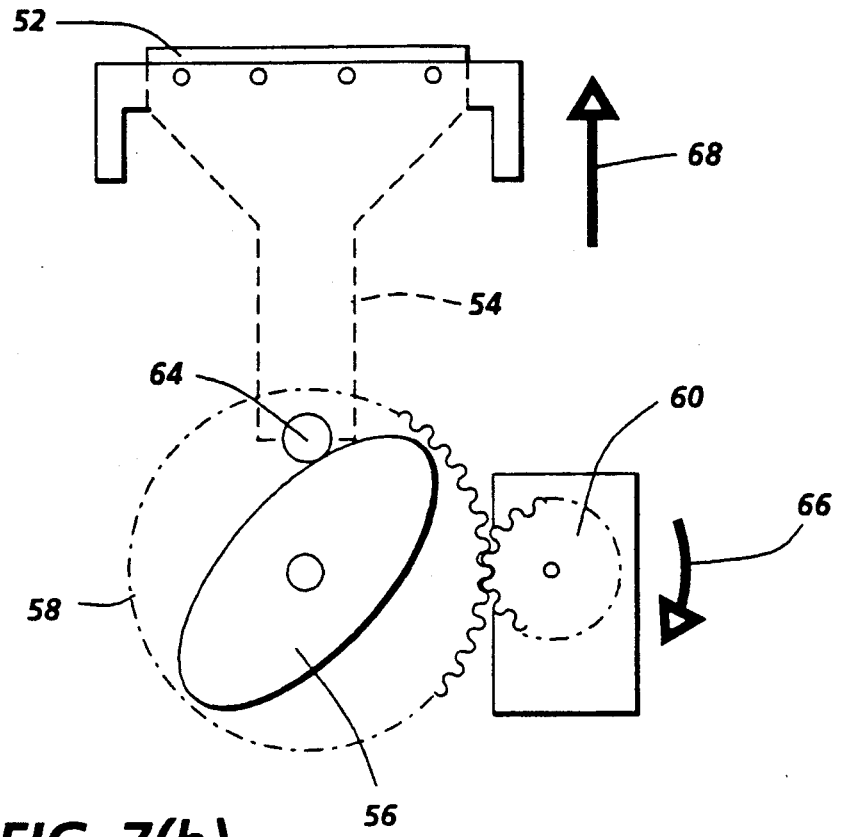
Figure 7C:
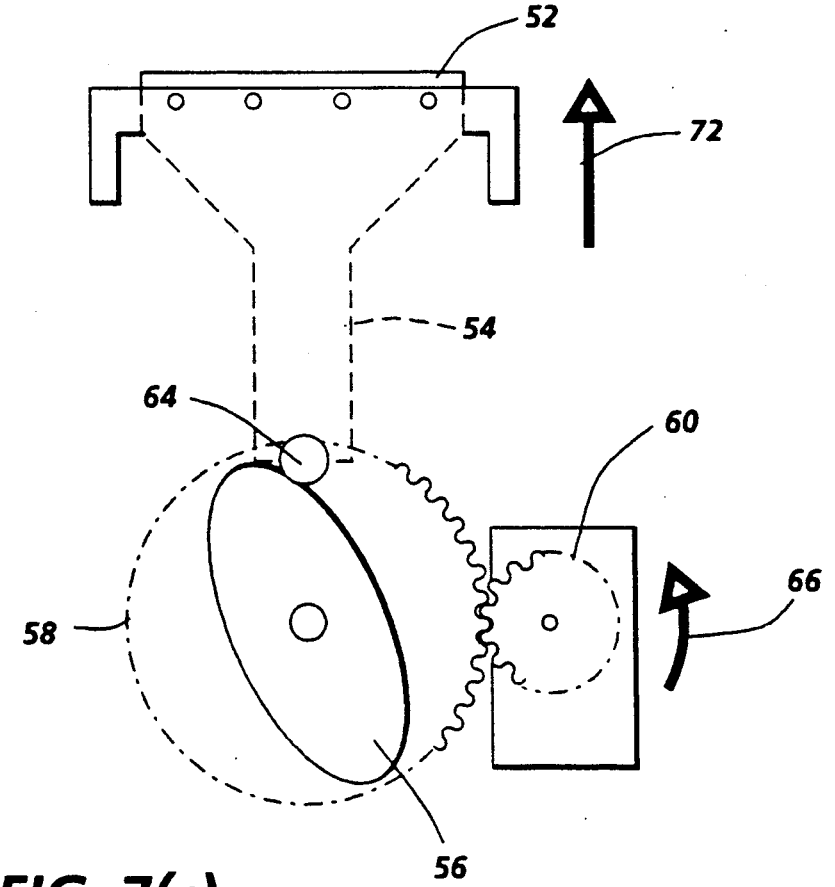

Turning to FIG. 6, the platen 52 adapted to support the computer form during imaging is mounted on the upper housing 54. The upper housing is raised and lowered by two platen position cams 56. Cams 56 are mounted on the front and rear optics drive gears 58. Drive gear 60 rotates gear 58. Motor 50 rotates gear 60. Gear 60 meshes with gear 58. As gear 58 rotates, cam 56 moves upper housing 54 in a vertical direction to position platen 52 at the correct location for the calculated magnification. The lower housing 62, which contains the lens, is raised and lowered by two linkage arms. The linkage arms are secured to the front and rear optics drive gears 58. The lens also moves in a horizontal direction to maintain the image in the corner registered position when reduction or enlargement is selected. The lower housing is raised for enlargement and lowered for reduction. It is clear that motor 50 moves both upper housing 54, which contains platen 52, and lower housing 62, which contains the lens. The upper housing and the lower housing are mechanically linked to the optics drive gear 58. Both of the housings move at the same time. The optics home sensor detects the location of the platen, via the upper housing, and sends a signal to the control logic of the centralized processing unit. Using the optics home sensor signal, and values entered into its non-volatile memory, the control logic determines the 100% magnification position. The 100% magnification position is adjustable by changing the values that are stored in the non-volatile memory of the control logic of the centralized processing unit. At initiation of power-on, or at the appropriate command, drive motor 50 moves the lens and platen to the home positions. Thereafter, motor 50 will rotate and each pulse will be counted. The count relative to the home position will be compared to numbers stored in the memory register of the centralized processing unit for the required magnification to "best fit" the image of the computer form onto the selected size copy sheet. The positive/negative aspect of the differences between the count and the stored number determines the direction of rotation of motor 50.

FIGS. *7a* through *7c*, inclusive, show the movement of platen 52 from the 100% position to a reduction and enlargement positions. As shown, cam follower 64 is mounted on upper housing 54 and rides on cam 56. FIG. *7a* shows the platen 52 at the 100% magnification position. As shown in FIG. *7b*, gear 60 is rotated in the direction of arrow 66 by motor 50 to move platen 52 in the direction of arrow 68 to the reduction position. As shown in FIG. *7c*, gear 60 is rotated in the direction of arrow 70 by motor 50 to move platen 52 in the direction of arrow 70 to the enlargement position. If platen 52 is in a reduction or enlargement position, and 100% magnification is required, then all movement occurs in the opposite direction and platen 52 is lowered.

In recapitulation, it is clear that the printing machine of the present invention automatically adjusts the magnification of an image of a computer from to insure that the image will fit on the copy. The number of sprocket holes of a computer form is inputted into the printing machine. The width of the computer form may be selected from one of four preset widths and inputted into the printing machine. In addition, the size of the selected copy sheet is inputted into the printing machine. This information is used to calculate the required magnification to "best fit" the image of the computer form onto the selected size copy sheet.

It is, therefore, evident that there has been provided in accordance with the present invention, a printing system for automatically fitting the image of a computer form on a selected size copy sheet which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

We claim:

1. A printing machine in which the magnification of an image of an original document having a plurality of equally spaced holes in at least one marginal edge thereof is adjusted for a selected size sheet, including:

input means for inputting the total number of holes along one marginal edge of the original document and the width of the original document in a direction substantially perpendicular to the edge of the original document having the holes therein and the selected size sheet;

calculating means, responsive to said input means, for determining the magnification of the image for the selected size sheet; and image forming means, responsive to said calculating means, for forming the image of the original document with the magnification adjusted for the selected size sheet.

2. A printing machine according to claim 1, wherein said input means includes means for indicating automatically the size of the selected sheet and transmitting a signal corresponding thereto to said calculating means.

3. A printing machine according to claim 1, wherein said input means includes:

storage means for storing a plurality of pre-set widths corresponding to the width of the original document; and operator selectable means for selecting one of the plurality of pre-set widths stored in said storage means.

4. A printing machine according to claim 3, wherein said operator selectable means includes means for adjusting the values of the plurality of pre-set widths in said storage means.

5. A printing machine according to claim 1, wherein said input means includes means for detecting the number of holes in the original document.

6. A printing machine according to claim 1, further including means, responsive to said image forming means, for reproducing the original document on the selected size sheet.

7. A printing machine according to claim 6, wherein said reproducing means includes:

a photoconductive member;

means for charging at least a portion of said photoconductive member to a substantially uniform level, said image forming means selectively discharging the charged portion of said photoconductive member to record a latent image thereon;

means for developing the latent image recorded on said photoconductive member with developer material;

means for transferring the developed image from said photoconductive member to the selected size sheet; and means for fusing the developed image to the selected size sheet to reproduce the original document thereon.

8. An image forming system in which the magnification of an image of an original document having a plurality of equally spaced holes in at least one marginal edge thereof is adjusted for a selected size sheet, including:

original size input means for inputting the total number of holes along one marginal edge of the original document and the width of the original document in a direction substantially perpendicular to the edge of the original document having the holes therein;

sheet size input means for inputting the size of the selected sheet; and calculating means, responsive to said original size input means and said sheet size input means, for determining the magnification of the image for the selected size sheet.

9. An image forming system according to claim 8, further including optical means, responsive to said calculating means, for forming the image of the original document with the magnification adjusted for the selected size sheet.

10. An image forming system according to claim 8, wherein said sheet size input means includes means for indicating automatically the size of the selected sheet and transmitting a signal corresponding thereto to said calculating means.

11. An image forming system according to claim 8, wherein said original size input means includes:

storage means for storing a plurality of pre-set widths corresponding to the width of the original document; and operator selectable means for selecting one of the plurality of pre-set widths stored in said storage means.

12. An image forming system according to claim 11, wherein said operator selectable means includes means for adjusting the values of the plurality of pre-set widths in said storage means.

13. An image forming system according to claim 12, wherein said original size input means includes means for detecting the number of holes in the original document.

14. An image forming system according to claim 8, further including means for storing the magnification of the image calculated by said calculating means as a default magnification value.

15. An image forming system according to claim 14, further including means, responsive to said storing means, for reproducing original documents on sheets at the default magnification value.

* * * * *